United States Patent [19]

Müller et al.

[11] Patent Number: 4,531,554

[45] Date of Patent: Jul. 30, 1985

[54] WEAVING MACHINE AND A METHOD FOR PRODUCTION OF A RIBBON-TYPE FASTENER

[75] Inventors: Jakob Müller, Stansstad, Switzerland; Ferdinand Diesner, Murg-Hänner, Fed. Rep. of Germany

[73] Assignee: Textilma AG, Hergiswil, Switzerland

[21] Appl. No.: 311,146

[22] Filed: Oct. 13, 1981

Related U.S. Application Data

[62] Division of Ser. No. 98,142, Nov. 21, 1979, Pat. No. 4,344,463.

[30] Foreign Application Priority Data

Dec. 5, 1978 [CH] Switzerland ..... 12400/78

[51] Int. Cl.[3] ..... D03D 47/40

[52] U.S. Cl. ..... 139/116; 139/432

[58] Field of Search ..... 139/116, 117, 118, 431, 139/432

[56] References Cited

U.S. PATENT DOCUMENTS

| | | | |
|---|---|---|---|
| 3,957,088 | 5/1976 | Muller | 139/117 |
| 4,007,763 | 2/1977 | Sellers | 139/116 |
| 4,027,703 | 6/1977 | Diesner | 139/117 |
| 4,174,738 | 11/1979 | Berger et al. | 139/432 |
| 4,181,159 | 1/1980 | Frohlich et al. | 139/116 |

FOREIGN PATENT DOCUMENTS

| | | | |
|---|---|---|---|
| 2519612 | 11/1975 | Fed. Rep. of Germany | 139/431 |

*Primary Examiner*—Henry S. Jaudon

*Attorney, Agent, or Firm*—Michael J. Striker

[57] ABSTRACT

A method and a machine for weaving a ribbon-type fabric in which a first weft-yarn is introduced into the warp shed by a first insertion organ and an auxiliary yarn is inserted into the warp shed by a second insertion organ at the side of the yarn shed where a knitting needle is positioned. A second weft yarn is also introduced into the warp shed at the side of the knitting needle. The needle catches the auxiliary yarn and the insertion organs are moved over the warp yarn shed so that the auxiliary-yarn loops formed run parallel to the weft-yarn loops over at least a part of the width of the warp shed.

19 Claims, 11 Drawing Figures

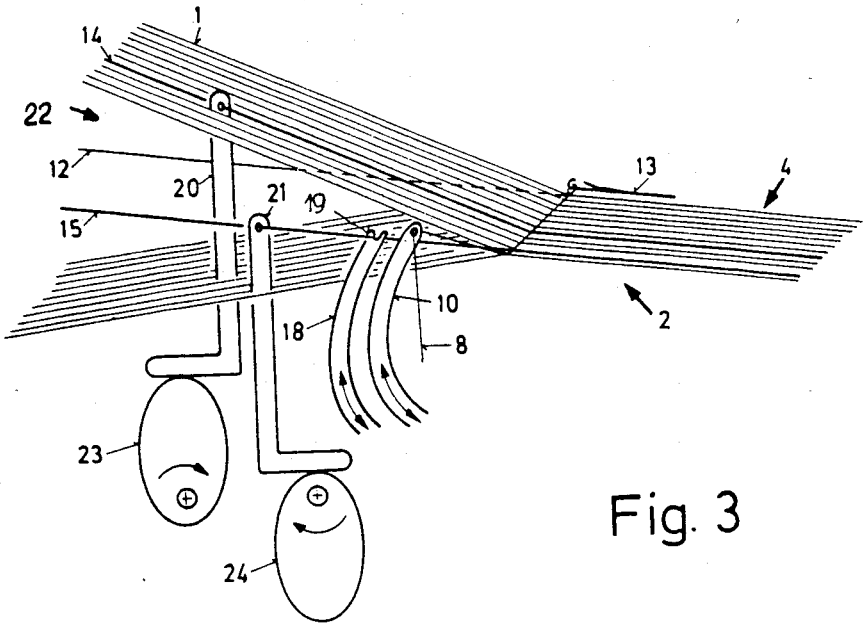
Fig. 3
Fig. 4
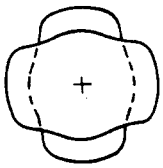
Fig. 5
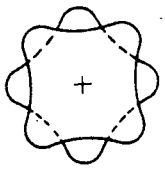
Fig. 6
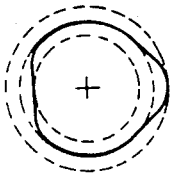

WEAVING MACHINE AND A METHOD FOR PRODUCTION OF A RIBBON-TYPE FASTENER

CROSS REFERENCE TO A RELATED APPLICATON

This application is a division of the application Ser. No. 98,142 filed Nov. 21, 1979 of J. Mueller et al now U.S. Pat. No. 4,344,463.

BACKGROUND OF THE INVENTION

The invention relates to a ribbon-type fabric as per the general category of claim 1, furthermore to a method for the production of the ribbon-type fabric and to a machine for the implementation of the method as per the general category of claim 12.

Ribbon-type fabrics as known, usually have weft-yarn loops introduced from one side of the warp shed and tied-off at the other side by a knitted edge. This knitted edge may be formed either by interlacing the weft-yarn loops in themselves, or by interlacing the weft-yarn loops with one or several auxiliary yarns. This ribbon-type fabric has the optical disadvantage of differing edges, wherein the knitted edge in particular will be relatively coarse. The knitted edge may cause a one-sided deformation of the ribbon-type fabric already during production. This disadvantageous property will be of an increased effect on washing the ribbon-type fabric. Finally, the mesh of the fabric must be held relatively wide since the knitting needle must be enabled to produce a knitted edge. The weft-yarn loops may therefore be drawn at the side of the knitting needle only to a limited extent. The aforementioned properties of ribbon-type fabrics are of disadvantage especially there, where such fabrics must be reeled up, or where, respectively, the ribbon edges are subjected to heavy wear, as, for instance, in safety belts for vehicular use.

A ribbon-type fabric is, furthermore, known from the DE Publication of Specifications No. 1 804 793, with weft-yarn loops being inserted from both sides and connected at the center of the ribbon-type fabric by means of an auxiliary yarn. Herein, the auxiliary yarn is drawn by a knitting needle effective vertically to the ribbon plane through the respective weft-yarn loops and interlaced with itself at one side of the ribbon-type fabric. This ribbon type will allow identical edges at both sides, but at the price of having a raised row of loops in the center of the ribbon. This is not only an optical disadvantage, but the exposed loop wales of the auxiliary yarn may easily become damaged or destroyed and this would cause the fabric of the ribbon to disintegrate.

SUMMARY OF THE INVENTION

It is the task of the invention, to create a ribbon-type fabric of the type as initially named, in which the joints of the weft-yarn loops are located between the edges of the ribbon and are not visible from the exterior.

This task is solved:

(a) with ribbon-type fabric of the type initially named, by the characterizing features of claim 1;

(b) with the method for the production of the ribbon-type fabric by the features of claim 6; and (c) with the ribbon weaving machine of the type initially named, by the characterizing features of claim 12.

It has been shown in a surprising manner, that the arrangement of the auxiliary yarn parallel to the weft-yarn loops will result in the joint of the weft-yarn loops caused by the auxiliary yarn to be drawn into the warp-yarn shed and be located between the warp yarn. This joint of the weft-yarn loops is not visible from the exterior and protected by the warp yarn. This will result in the ribbon fabric having not only an externally uniform appearance, but also in the critical joint of the weft-yarn loops being located within the warp yarn where they are protected. By locating the joint of the weft-yarn loops between the fabric edges, a uniform structure of the ribbon fabric is achieved, so that unilateral deformation is avoided. This construction of the ribbon-type fabric also has the decisive advantage that, on drawing-in of the joint between the weft-yarn loops, the warp yarn will be drawn together at both sides towards the center of the ribbon fabric so that a dense warp will result, ensuring a ribbon-type fabric highly resistant to wear. This construction of the novel ribbon-type fabric will furthermore ensure that no deformation will result by washing.

The novel ribbon-type fabric is suitable for the most differring purposes, particularly for applications where high demands are set for such a ribbon-type fabric, as is the case with, for instance, safety belts for vehicular use, lifting slings and belting for shutters.

The claims 2 to 5 delineate advantageous embodiments of the ribbon-type fabric.

Advantageous embodiments of the method for the production of the ribbon-type fabric are delineated in claims 7 to 11.

The method for the production of the ribbon-type fabric, as well as the ribbon weaving machine for the implementation of the method are disinguished by particular simplicity.

Contrary to customary ribbon production, merely one additional organ for inserting the auxiliary yarn is required herein, also acting from the side of the weft-yarn inserting organ and possibly coupled to it. Customary ribbon weaving machines may thus be adapted in a simple manner for the production of the novel fabric.

Advantageous embodiments of the ribbon weaving machine are delineated in claims 13 to 18.

Examples of embodiments of the subject of the invention are described more closely below with the aid of schematic drawings showing:

BRIEF DESCRIPTION OF THE DRAWINGS

FIG. 3 parts of a ribbon weaving machine for the production of the ribbon-type fabric of FIG. 2, perspective drawing;

FIGS. 4 and 6, control cams for the drive of yarn-carrier elements of the ribbon weaving machine of FIG. 3;

DESCRIPTION OF THE PREFERRED EMBODIMENTS

Figure 1:
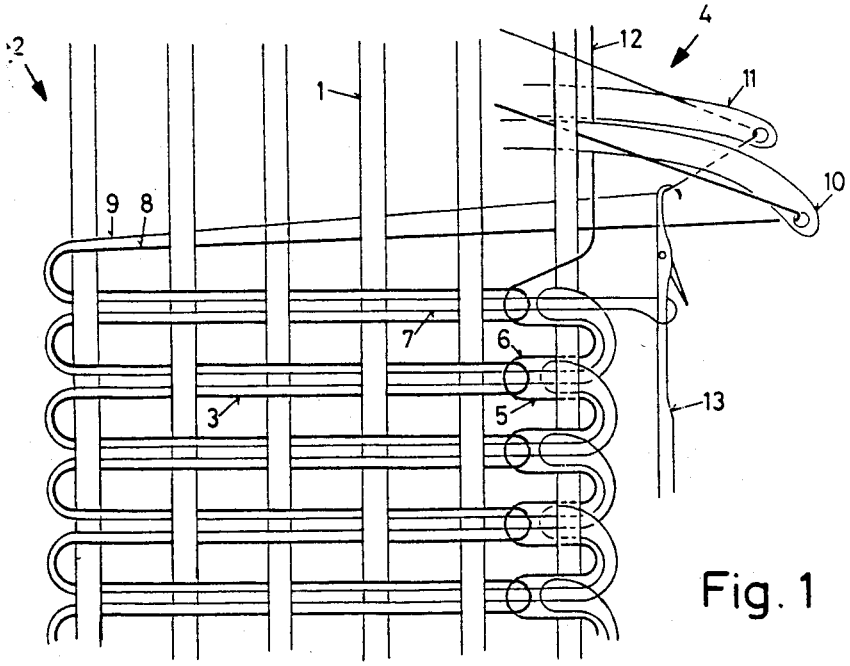
FIG. 1 a first ribbon-type fabric with an auxiliary yarn whilst in production, top view.

The ribbon-type fabric of FIG. 1 has warp yarn 1, with first weft-yarn loops 3 woven into these from the inserting side 2, and second weft-yarn loops 5 woven into from the knitting-needle side 4. The joints 6 of the first weft-yarn loops 3 with the second weft-yarn loops 5 are located between the fabric edges and are formed by one auxiliary-yarn loop 7 drawing in the respective instance the second weft-yarn loops 5 into the first weft-yarn loops 3 and holding there therein. The auxiliary-yarn loops 7 run across the entire width of the ribbon-type fabric and are laid parallel to the weft-yarn loops. The auxiliary yarn is interlaced in itself.

To produce the ribbon-type fabric as per FIG. 1, a first weft yarn 8 and an auxiliary yarn 9 are carried in at the inlet side 2 and inserted by means of an inserting organ 10 for weft yarn 8 and an inserting organ 11 for auxiliary yarn 9 into the warp shed until the opposite side, the knitting-needle side 4 is reached. A second weft yarn 12 is inserted at the knitting needle side 4 and laid between the inserted first weft yarn 8 and the auxiliary yarn 9. A knitting needle 13, carrying the last loop 7 formed of the auxiliary yarn will catch the auxiliary yarn 9 and draw it through the last loop 7 formed of the auxiliary yarn, interlacing thereby with the first weft-yarn 8 and the second weft yarn 12, the last loop 7 formed of the auxiliary yarn being knocked-off herein. On returning of the inserting organ for the weft yarn 10 and the inserting organ for the auxiliary yarn 11, the first loop 3 formed of the weft yarn and the second loop 5, formed of the weft yarn, are formed, as is the loop 7 formed by the auxiliary yarn. By feeding or suitable pretensioning of the second weft yarn 12, the second weft-yarn loop 5 may be drawn into the warp shed on returning of the weft-yarn inserting organ 10 and the auxiliary-yarn inserting organ 11, so that the joint 6 will be located between the edges of the ribbon-type fabric. The dimension of the drawing-in can be determined by the dimension of feeding or pretensioning of the second weft yarn. Drawing-in the joint 6 of the first weft-yarn loop 3 with the second loop 5 formed of the weft yarn will also cause drawing the knocked-off weft-yarn loop into the warp shed. The inserted loops are beaten-up by the reed which is not shown in closer detail. The inserted loops are clamped fast upon change of the warp shed. In the ribbon-type fabric shown, the auxiliary yarn 11 is thus interlaced with itself.

Figure 2:
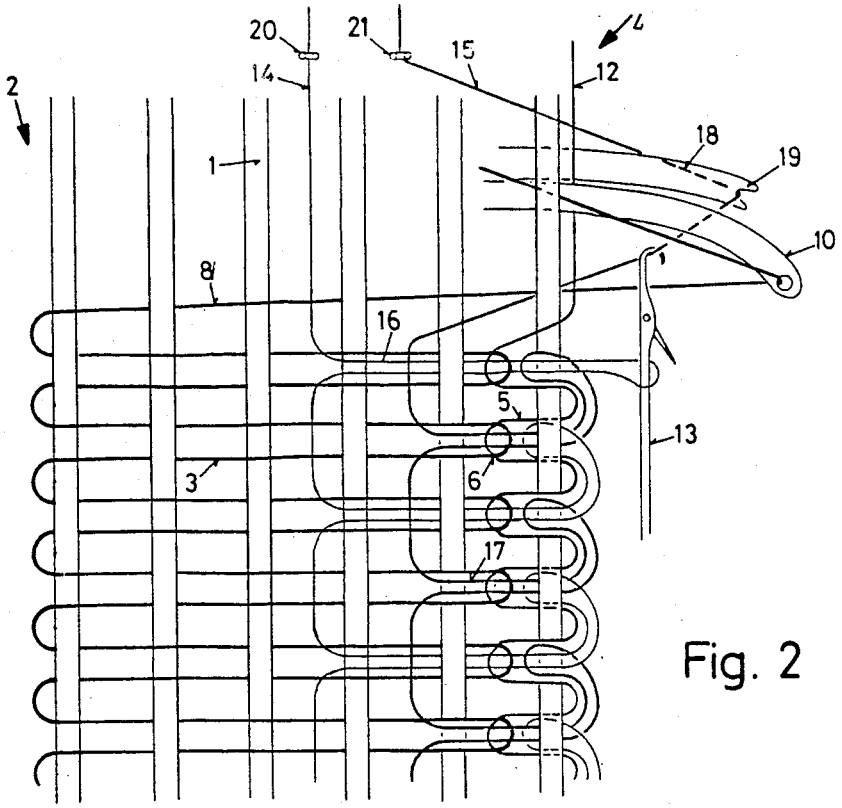
FIG. 2 a second ribbon-type fabric with two auxiliary yarns whilst in production, top view.

The ribbon-type fabric of FIG. 2 corresponds to the ribbon-type fabric of FIG. 1, so that identical parts are identified by identical reference signs. Contrary to the ribbon-type fabric of FIG. 1, two auxiliary yarns 14,15 are present in the ribbon-type fabric of FIG. 2, forming loops 16 and 17, both formed of the auxiliary yarn, which are running only over a part of the width of the ribbon fabric, with the auxiliary-yarn loops serving for the alternating joining of the first weft-yarn loop 3 and the second weft-yarn loop 5. The auxiliary yarns 14 and 15 are, in this example, not tied-off in themselves but with the respective other auxiliary yarn. A locking yarn may, furthermore, be provided.

As can be seen from FIGS. 2 and 3, production of the ribbon-type fabric will ensue as follows: The first weft yarn 8 is inserted by means of the weft-yarn inserting organ 10 into the warp shed from the inserting side 2. An auxiliary-yarn inserting organ 18 will move through the warp shed together with the weft-yarn inserting organ 10, with the auxiliary-yarn inserting organ having a fork-shaped carrier 19. The first auxiliary yarn 14 and the second auxiliary yarn 15 are carried-in analogous to the warp yarns 1, wherein, however, the yarn-carrier elements 20 and 21 are provided in order to bring the respective first auxiliary yarn 14 or the second auxiliary yarn 15 into the carrying range of the auxiliary-yarn inserting organs 18, so that the respective first auxiliary yarn 14 or second auxiliary yarn 15 will alternatingly be brought onto the knitting-needle side 4, and into the carrying range of the knitting needle 13. The weaving sequence will then ensue in the same manner as with the ribbon-type fabric of FIG. 1, wherein, however, the interlacing of the of the weft yarn will alternatingly be made with the first and the second auxiliary yarn 14 or 15 respectively, with the latter being tied-off not in themselves but with the respective other auxiliary yarn.

FIG. 3 shows in a schematic view of essential elements of a ribbon weaving machine for the production of a ribbon-type fabric as per FIG. 2. Thus, the ribbon weaving machine is provided with a weft-yarn inserting organ 10 reaching through the warp shed 22 formed by the warp yarn 1, and also with an auxiliary-yarn inserting organ 18. These may, in the respective instance be provided with a separate or a common drive. The possibility also exists of assembling the inserting organs together, in such a manner that only one organ is provided with an inserting part for the auxiliary yarn and an inserting part for the weft yarn. It would also be possible to use one inserting organ for the auxiliary yarn and weft yarn, reaching into the warp shed from the side of the knitting needle and drawing-out the auxiliary yarn(s) on the knitting-needle side, as will later be explained in detail using FIG. 11. The ribbon weaving machine is furthermore provided with a known device, not shown, for the feeding and pretensioning of the second weft yarn. The knitting needle 13 is arranged on the knitting needle side 4, located opposite to the inserting side 2. Yarn-carrier elements 20 and 21, driven over the cams 23 and 24 serve for carrying the first auxiliary yarn 14 and the second auxiliary yarn 15. FIGS. 4 and 6 show additional cams suitable for driving the yarn-carrier elements 20 and 21. In addition, the ribbon weaving machine may be constructed with a device for inserting a locking yarn as known, per se, for the prevention of disintegration of a ribbon-type fabric. The remaining construction of the ribbon weaving machine may be of customary design, so that this need not be discussed in detail.

Figure 7:
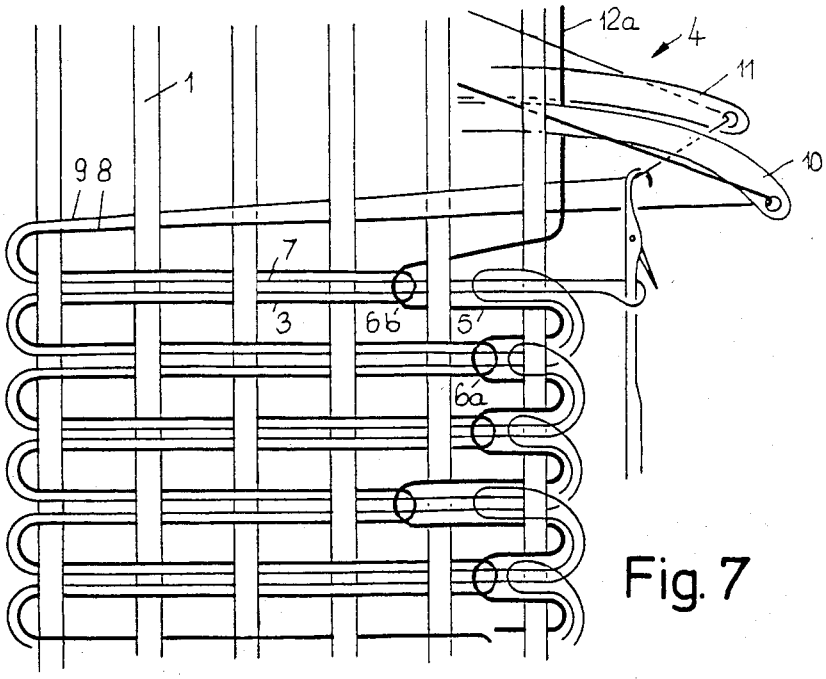
FIG. 7 a third ribbon-type fabric analogous to that of FIG. 1, with laterally offset joints of the weft yarn whilst in production, top view.

FIG. 7 shows a third ribbon-type fabric constructed analogous to the one of FIG. 1, so that identical parts are identified by identical reference signs as in FIG. 1. In the instance of the ribbon-type fabric of FIG. 7 however, the second weft yarn 12*a* is provided with a periodically alternating feed or an alternating pretensioning, so that the joints 6*a* and 6*b* respectively of the first weft-yarn loop 3 and the second weft-yarn loop 5 are drawn into the ribbon fabric at varying distances from the edge of the warp shed. By the aforegoing, the construction of the ribbon-type fabric will become even more uniform and the tying-off of the weft-yarn loops more stable.

Figure 8:
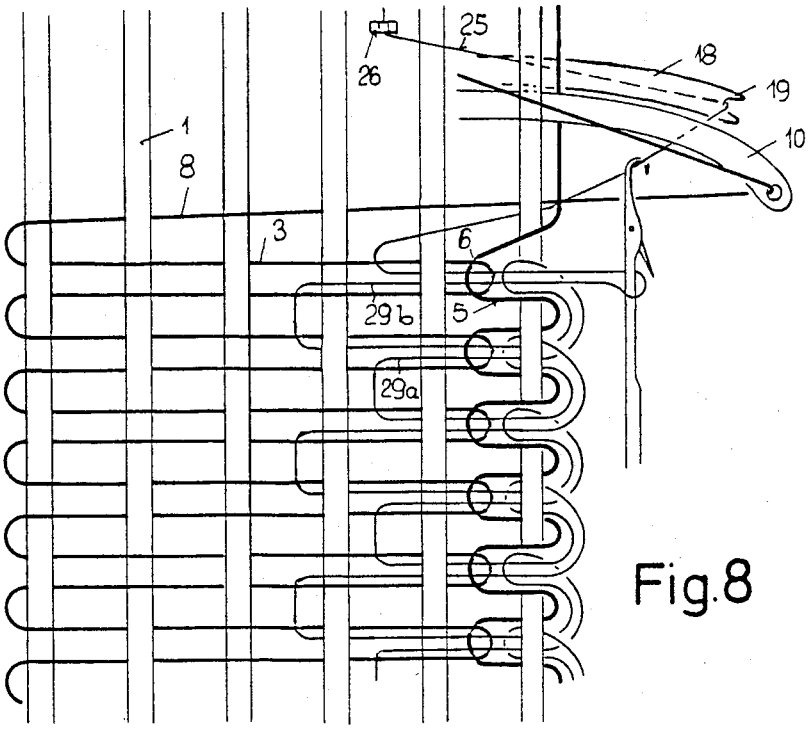
FIG. 8 a fourth ribbon-type fabric similar to that of FIG. 2, however with an auxiliary yarn led at different widths across the ribbon-type fabric, whilst in production, top view.

The ribbon-type fabric shown in FIG. 8 is somewhat similar to the one of FIG. 2, so that identical parts are again identified by the same reference signs. Contrary to the ribbon-type fabric of FIG. 2, the one of FIG. 8 is provided with only one auxiliary yarn 25, inserted along the warp yarn and carried by the yarn-carrier element 26 into the warp shed 22 lateral to the plane of the ribbon-type fabric. This is accomplished by means of a lift-control device 27, shown in detail in FIGS. 9 and 10. A lateral-control device 28 allows inserting the carrier element 26 into the warp shed 22 at periodically alternating locations. It follows therefrom that, similar to the embodiment of FIG. 2, the auxiliary-yarn loops *26a,26b*, which are tied-off in themselves, are led at different widths across the ribbon-type fabric. In this construction of the ribbon-type fabric a greater uniformity of the ribbon-type fabric is also achieved. Added to this is, above all, that the alternating lengths of the auxiliary-yarn loops *29a, 29b* an increase in the bends of the auxiliary yarn is achieved as well as varying crossing points of the auxiliary yarn with the warp yarns which will achieve an essential improvement in the durability of the ribbon-type fabric.

Figure 9:
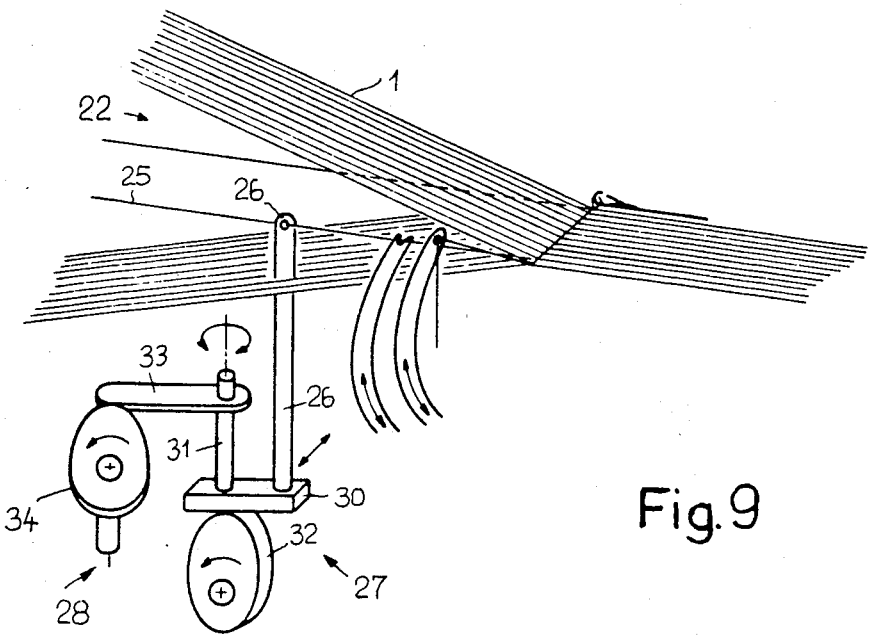
FIGS. 9 and 10, portions of a ribbon weaving machine for the production of ribbon-type fabric of FIG. 8, in perspective drawing.
Figure 10:
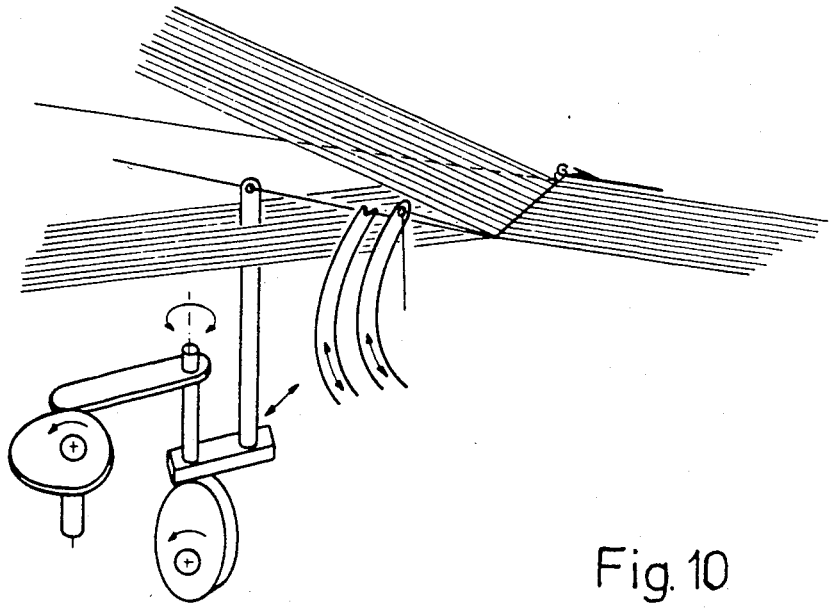

The band weaving machine for the production of the ribbon-type fabric as per FIG. 8, shown in part in FIGS. 9 and 10, is, as already noted, provided with a lifting control device 27 and a lateral control device 28, for the yarn carrier element 26. For this purpose, the yarn-carrier element 26 is arranged on a cross support 30 attached to an axle 31 which has a bearing that allows swivelling and height adjustment. The height-adjusting cam 32 serves to lift and lower the cross support. A lateral-control lever 33, linked to the axle 33, acts conjointly with a lateral control cam 34, effecting swivelling of the axle 31 and thus a displacement of the yarn-carrier element 26 along the width of the warp shed 22.

Figure 11:
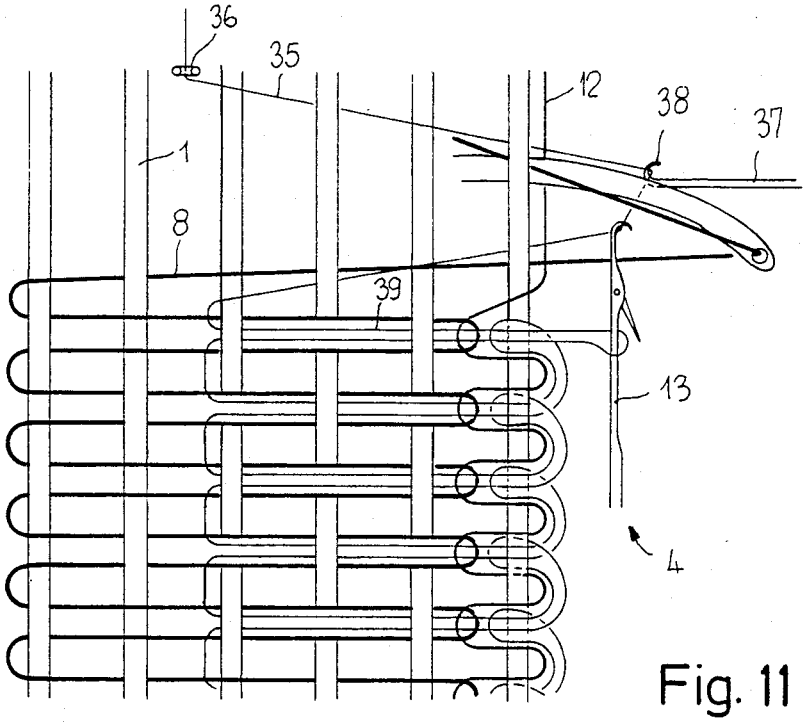
FIG. 11 a fifth ribbon-type fabric whilst in production, top view.

FIG. 11 shows in turn a fifth ribbon-type fabric, constructed similar to that of FIG. 8 with the sole auxiliary yarn 35 being led only across a part of the width of ribbon fabric. This is again accomplished by a yarn-carrier element 36 piercing from below into the warp shed 22, so that the auxiliary yarn 35 may again reach into the knitting range of an auxiliary-yarn inserting organ 37. Contrary to the embodiments described hitherto, the latter is arranged at the knitting-needle side 4 and is provided with a catcher hook 38 which can take hold of the auxiliary yarn 35 brought into the warp shed and can draw it through to the knitting-needle side 4 of the ribbon fabric, concomitantly forming an auxiliary-yarn loop 39, the auxiliary-yarn loop 39 then being taken up in the usual manner by the knitting needle 13. With this embodiment, the auxiliary-yarn loop 39 will always be of the same length and will again be tied-off in itself.

It will be understood that each of the elements described above, or two or more together, may also find a useful application in other types of arrangements differing from the types described above.

While the invention has been illustrated and described as embodied in a method of forming a type-ribbon fabric it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of weaving a ribbon-type fabric in a ribbon type weaving machine having an inserting member for the weft yarn and a movable knitting needle, comprising the steps of inserting from one side of the warp shed a first weft-yarn by means of a weft-yarn inserting tool and forming a first weft-yarn loop; inserting at least one auxiliary yarn over at least a part of the warp shed by means of an auxiliary-yarn inserting tool; drawing-in a second weft yarn between said first weft yarn and said auxiliary yarn; and drawing the auxiliary yarn so that the auxiliary yarn interlaces on the other side of the warp shed through the first weft-yarn loop with the first weft yarn drawing said second weft yarn into the warp shed thus forming a second weft-yarn loop, and also concomittantly interlacing the auxiliary yarn with itself while guiding at least one auxiliary yarn in the direction transverse the warp yarns and bringing the former, by means of a yarn-carrying element, at varying distances from the edge of the warp shed, into the carrying range of said inserting tool for auxiliary yarn.

2. A method as defined in claim 1, wherein the magnitude of the drawing-in of the second weft-yarn loop is determined by the rate of feeding of the second weft yarn.

3. A method as defined in claim 1, wherein the magnitude of the drawing-in of the second weft-yarn loop is determined by the magnitude of a predetermined tensioning of the second weft yarn.

4. A method as defined in claim 1, wherein the magnitude of the drawing-in of the second weft-yarn loop is determined by the ratio of feeding and the magnitude of the predetermined tensioning of the second weft yarn in periodic alternation.

5. A method as defined in claim 1, further comprising guiding the first weft yarn and the auxiliary weft yarn from one side through the warp shed into the carrying range of the knitting needle arranged on the other side of the warp shed, and upon the drawing-in of the second weft yarn between the first weft yarn and the auxiliary yarn catching the auxiliary yarn by means of the knitting needle to form an auxiliary-yarn loop, concomittantly interlacing the first and second weft yarn.

6. A method as defined in claim 5, further comprising the step of holding together a number of weft-yarn loops, alternatingly, by means of a first and a second auxiliary yarn, and the step of leading the second auxiliary yarn, together with the first weft yarn over at least a part of the width of the warp shed.

7. A method as defined in claim 1, further comprising the step of holding together a number of weft-yarn loops, alternatingly, by means of a first and a second auxiliary yarn, and the step of leading the second auxiliary yarn, together with the first weft yarn over at least a part of the width of the warp shed.

8. A method as defined in claim 1, wherein at least one auxiliary-yarn loop is formed by means of a hook-shaped inserting tool and drawn from the side of the knitting needle into the warp shed.

9. A method of weaving a ribbon-type fabric in a ribbon-type weaving machine having an inserting member for the weft yarn and a knitting needle, comprising the steps of inserting from one side of the warp shed a first weft-yarn by means of a weft-yarn inserting tool and forming a first weft-yarn loop; inserting at least one auxiliary yarn over at least a part of the warp shed by means of an auxiliary-yarn inserting tool; drawing-in a second weft yarn between said first weft yarn and said auxiliary yarn; and drawing said auxiliary yarn so that the auxiliary yarn interlaces on the other side of the warp shed through the first weft yarn loop with the first weft yarn drawing said second weft yarn into the warp shed thus forming a second weft-yarn loop, and also concomittantly interlacing the auxiliary yarn with an additional auxiliary yarn while guiding at least one auxiliary yarn in the direction transverse the warp yarns and bringing the former, by means of a yarn-carrying element, at varying distances from the edge of the warp shed, into the carrying range of said inserting tool for auxiliary yarn.

10. A method as defined in claim 9, wherein the magnitude of the drawing-in of the second weft-yarn loop is determined by the rate of feeding of the second weft yarn.

11. A method as defined in claim 9, wherein the magnitude of the drawing-in of the second weft-yarn loop is determined by the magnitude of a predetermined tensioning of the second weft yarn.

12. A method as defined in claim 9, wherein the magnitude of the drawing-in of the second weft-yarn loop is determined by the ratio of feeding and the magnitude of a predetermined tensioning of the second weft yarn in periodic alternation.

13. A method as defined in claim 12, further comprising the step of holding together a number of weft-yarn loops, alternatingly, by means of a first and a second auxiliary yarn, and the step of leading the second auxiliary yarn, together with the first weft yarn is led over at least a part of the width of the warp shed.

14. A method as defined in claim 9, further comprising the step of holding together a number of weft-yarn loops, alternatingly, by means of a first and a first and a second auxiliary yarn, and the step of leading the second auxiliary yarn, together with the first weft yarn over at least a part of the width of the warp shed.

15. A method as defined in claim 9, wherein at least one weft-yarn loop is formed by means of a hook-shaped inserting tool and drawn from the side of the knitting needle into the warp shed.

16. A weaving machine for weaving a ribbon-type fabric, comprising an inserting tool for inserting a first weft yarn into a warp shed which has one side and another side; a movable knitting needle arranged at another side of the warp shed; said weft yarn inserting tool inserting a first weft yarn from one side of the warp shed and moving the first weft yarn through the warp shed to form at least one first weft-yarn loop; a device for carrying an auxiliary yarn and including an inserting tool for the auxiliary yarn to draw the latter so that the auxiliary yarn extends in the direction of insertion at least over a part of the width of the warp shed to form an auxiliary yarn loop; and a device for carrying and feeding a second weft yarn between the inserting tool for the weft yarn and the inserting tool for the auxiliary yarn and located at said another side of the warp shed, whereby said second weft yarn is drawn into the warp shed and a second weft-yarn loop is formed, said knitting needle being movable to and fro through the first weft yarn loop and catching the auxiliary yarn loop to draw the latter through the first weft yarn loop.

17. A weaving machine as defined in claim 1, further comprising on said one side of the warp shed an insertion member provided with at least one catching hook and movable through the warp shed to carry the auxiliary yarn.

18. A weaving machine as defined in claim 16, wherein the auxiliary-yarn carrying device carries two auxiliary yarns alternatingly.

19. A weaving machine as defined in claim 18, further comprising at least one yarn-carrying element which guides a portion of at least one auxiliary yarn along the direction of the warp shed into the carrying range of the inserting tool for the auxiliary yarn at varying distances from the edge of the warp shed.

* * * * *